US005192064A

United States Patent [19]

Rusconi

[11] Patent Number: 5,192,064

[45] Date of Patent: Mar. 9, 1993

[54] AUTOMATIC THIN WEB FEED AND CUT MECHANISM FOR FEEDING, CUTTING AND MATCHING THIN WEBS WITH PANEL EDGES

[75] Inventor: John Rusconi, Milpitas, Calif.

[73] Assignee: Max Kahn Curtain Corporation, New York, N.Y.

[21] Appl. No.: 808,362

[22] Filed: Dec. 16, 1991

[51] Int. Cl.[5] ..... B65H 41/00; B65H 39/02

[52] U.S. Cl. ..... 270/52.5; 270/58

[58] Field of Search ..... 270/21.1, 52, 58, 59, 270/95, 52.5

[56] References Cited

U.S. PATENT DOCUMENTS

| | | | |
|---|---|---|---|
| 3,979,112 | 9/1976 | Munn | 270/59 |
| 4,749,179 | 6/1988 | Hornung | 270/95 |
| 4,944,503 | 7/1990 | Arima | 270/95 |
| 5,020,786 | 6/1991 | Kimura | 270/95 |
| 5,096,176 | 3/1992 | Golicz | 270/95 |

*Primary Examiner*—Edward K. Look
*Assistant Examiner*—John Ryznic
*Attorney, Agent, or Firm*—Kenyon & Kenyon

[57] ABSTRACT

The invention provides an apparatus for feeding narrow web material to be sewn into larger panels moving along a conveyor in a larger, host, process line so as to dispose the web material even with a passing panel.

14 Claims, 3 Drawing Sheets

AUTOMATIC THIN WEB FEED AND CUT MECHANISM FOR FEEDING, CUTTING AND MATCHING THIN WEBS WITH PANEL EDGES

BACKGROUND OF THE INVENTION

1. Field of the Invention

The present invention relates to textile web and panel processing equipment in the sewing industry, and more particularly to feeding narrow web material to be sewn into larger panels moving along a conveyer in a larger, host, process line.

2. Description of Related Art

Existing systems for assembly of large panel material such as draperies, bed sheets, blankets, curtains and the like automate the assembly of such material by taking panels from continuous rolls cutting the panels to size and conveying them through the forming assembly and sewing steps on wide conveyers. Typically among the process steps is the feeding of narrow web material, such as interfacing or buckram, along the moving panel and subsequent attachment of the narrow web material to the moving panel, generally by sewing.

Present systems feed narrow web material from a continuous roll without cutting of the narrow web until after it is joined to the separate panels. This process produces a web piece longer than the width of the panel with no convenient way to automatically trim the web even with the edge of the panel. This creates some waste of web material and causes the need for a manual trim or fold step in the processing of the assembled product.

Accordingly there is a need for an apparatus to synchronously feed narrow web material from roll stock, merging the web with a passing panel, and stop and start the feed of the material to make the material ends coincident with the edges of passing panels of the material fed through a process line. The device must also be able to trim the web material to length and be able to work in conjunction with the process line and the method of joining the panels, be it sewing machine or other means.

SUMMARY OF THE INVENTION

The present invention provides an apparatus for synchronous discontinuous feeding and cutting of narrow web materials which may be incorporated into a textile panel handling system. The apparatus is capable of sensing the leading and trailing edges of each panel as it passes. The apparatus synchronously feeds and cuts narrow web material merging it with passing panels so that the leading and trailing edges of the web material are coincident with the leading and trailing edges of the passing textile panels being processed.

The apparatus includes means for separately sensing the leading and trailing edges of the panel being processed for accurately starting and stopping the feed of the web material to coincide with the passing of these edges and for accurately cutting the web material being fed to coincide with the stopping of web feed. The web feeding portion of the apparatus includes means for releasing the web material under controlled tension from a large supply roll, straightening and guiding the web material and synchronizing the apparatus with the textile handling system to assure the speed is always consistent between the apparatus and the host unit.

In a preferred embodiment of the invention the apparatus is disposed beneath the moving panel conveyer on a separately movable low profile frame which may be attached to the main system frame. The release point of the web material is immediately ahead of the device for joining the two materials within the system, which is a sewing machine in the preferred embodiment.

The web feeding means comprises a driven set of parallel tractor rollers which can be moved in opposition by means of a cylinder. The rollers are mechanically coupled to a powered clutch and brake which couples the apparatus through a drive shaft directly to the drive of the host panel feed system to provide rotary motion synchronized with the speed of the host system, and to provide fast accurate stop and start of the web feed.

The tractor rollers comprise the means of propelling the web material to start each cycle. In the preferred embodiment two parallel tractor rollers are pneumatically actuated to move in opposition in such a manner that the web material is held between the rollers under some pressure at the point of tangency of the rollers and constrained to move in line with the tangent point of the two rollers under the influence of roller rotation. The roller pair is positioned so that their point of tangency or nip is in line with the material path, immediately disposed to enter an opening between a guide and a cutter anvil to encourage the web being fed to move in this direction, in line with the point of tangency of the rollers, during roller rotation and while torque is applied to the rollers.

One of the tractor rollers is mechanically attached through a drive system to the clutch and brake at which point the web feed system derives rotational motion direction from the drive of the host panel handling system. Engagement of the clutch and release of the brake through electrical or pneumatic means causes the drive to quickly accelerate and to turn at a speed synchronized with the feed of the main panel handling system. Conversely, release of the clutch and application of the brake cause the roller to cease rotation and to hold the web stationary in the system.

The second tractor roller, in a preferred embodiment, is mechanically constrained to move parallel to the first roller on a pivot. This roller is influenced to move to, and press against, the first (powered) roller by means of a pair of pneumatic cylinders. The cylinders, when activated create sufficient force between the rollers to engage the web material and thus influence its movement tangential to the point of roller contact. When retracted, the cylinders move the second roller away from the powered roll, creating a gap sufficient to allow the web material to slide between the rolls. This allows the web to be pulled through the web feed system by the host panel processing system once the web has been initially fed and engages the moving panel and pinch belts of the host panel process system.

The means for severing the narrow web in a preferred embodiment comprises a sharpened metal cutter driven in opposition to a smooth anvil surface. The cutter, which rides on guides, is driven in opposition to the anvil by a pair of pivoting links joined at a center pivot.

A smooth guide is disposed across the opening of the cutter in a preferred embodiment of the system. This guide supports the free end of the material after it has been severed and positions it in line to feed above the retracted blade edge, thus preventing the web material from snagging on the blade during periods of web movement.

In a preferred embodiment the means of detecting the leading and trailing edges of the passing panel is provided by two commercial optical proximity sensors which put out a thin beam of light which reflects off of the top of a shiny plate on the top of the system. As the panel passes it interrupts the reflection of the sensors which in turn sends an electrical signal to control the stopping and starting of the web feed system.

Separate sensors are provided for detection of the leading and trailing edge of the panel. These sensors are separately mounted on a sliding bracket allowing the sensors to be disposed toward or away from the oncoming direction of panel travel, creating in this way adjustment in the position of each end of the web with respect to the ends of the panel.

In a preferred embodiment the apparatus controller is a commercial programmable controller unit which receives signals from the various sensors and switches within the apparatus and in turn sends out signals which operate solenoid powered air valves or clutches to appropriately control the actions of the apparatus.

DETAILED DESCRIPTION OF THE INVENTION

The present invention provides an apparatus for feeding a thin web material into a moving textile assembly line processing panels of material. The apparatus is configured to detect the passage of the leading and trailing edges of each panel and synchronously start and stop the feed of the web material to coincide with the passage of the leading and trailing edges, respectively, of the panel and to trim the web material even with the respective edges of the passing panel.

Figure 1:
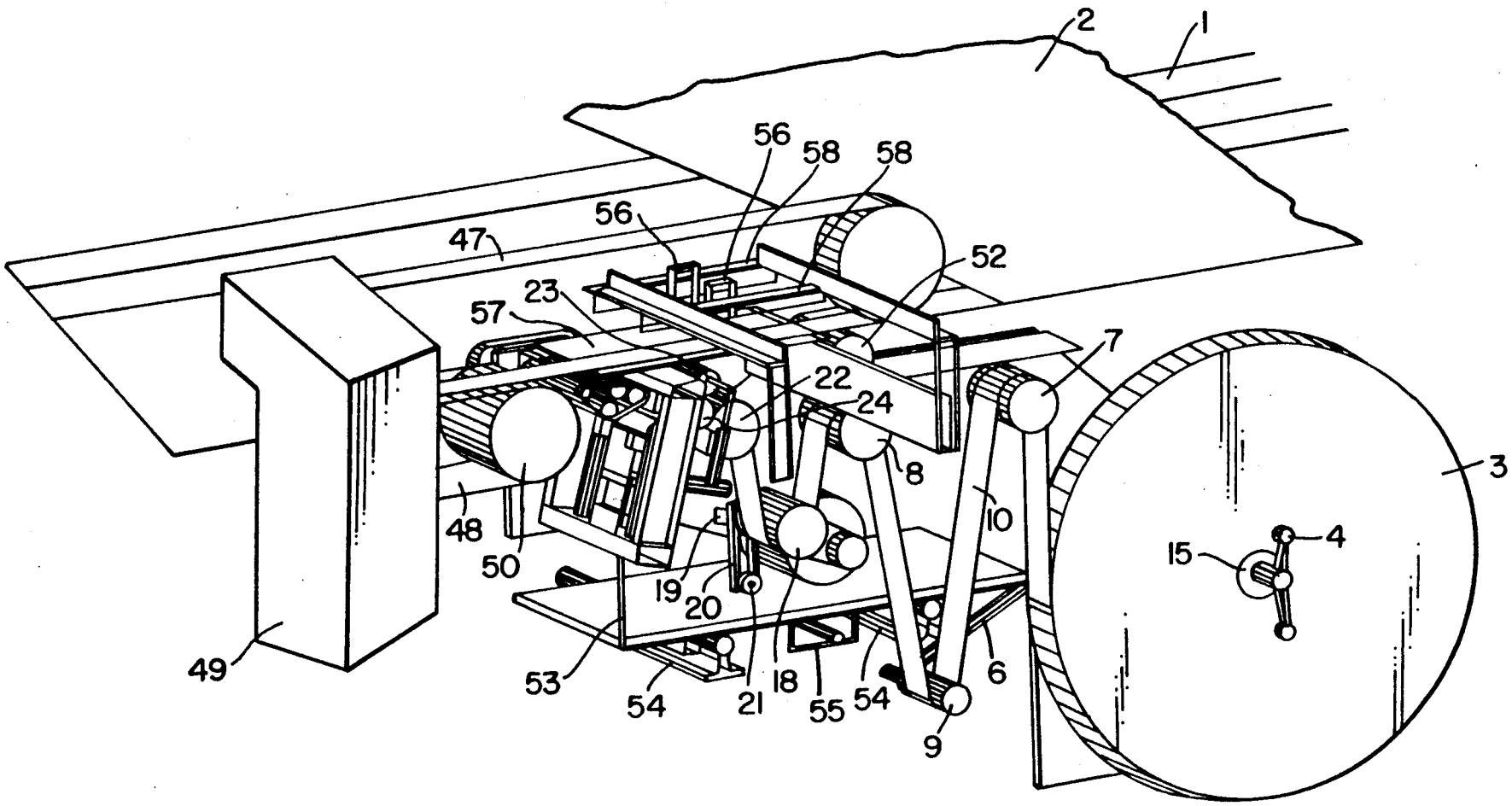
FIG. 1 is a perspective view of a preferred embodiment of the apparatus of the present invention as viewed from the top front of the apparatus.
Figure 2:
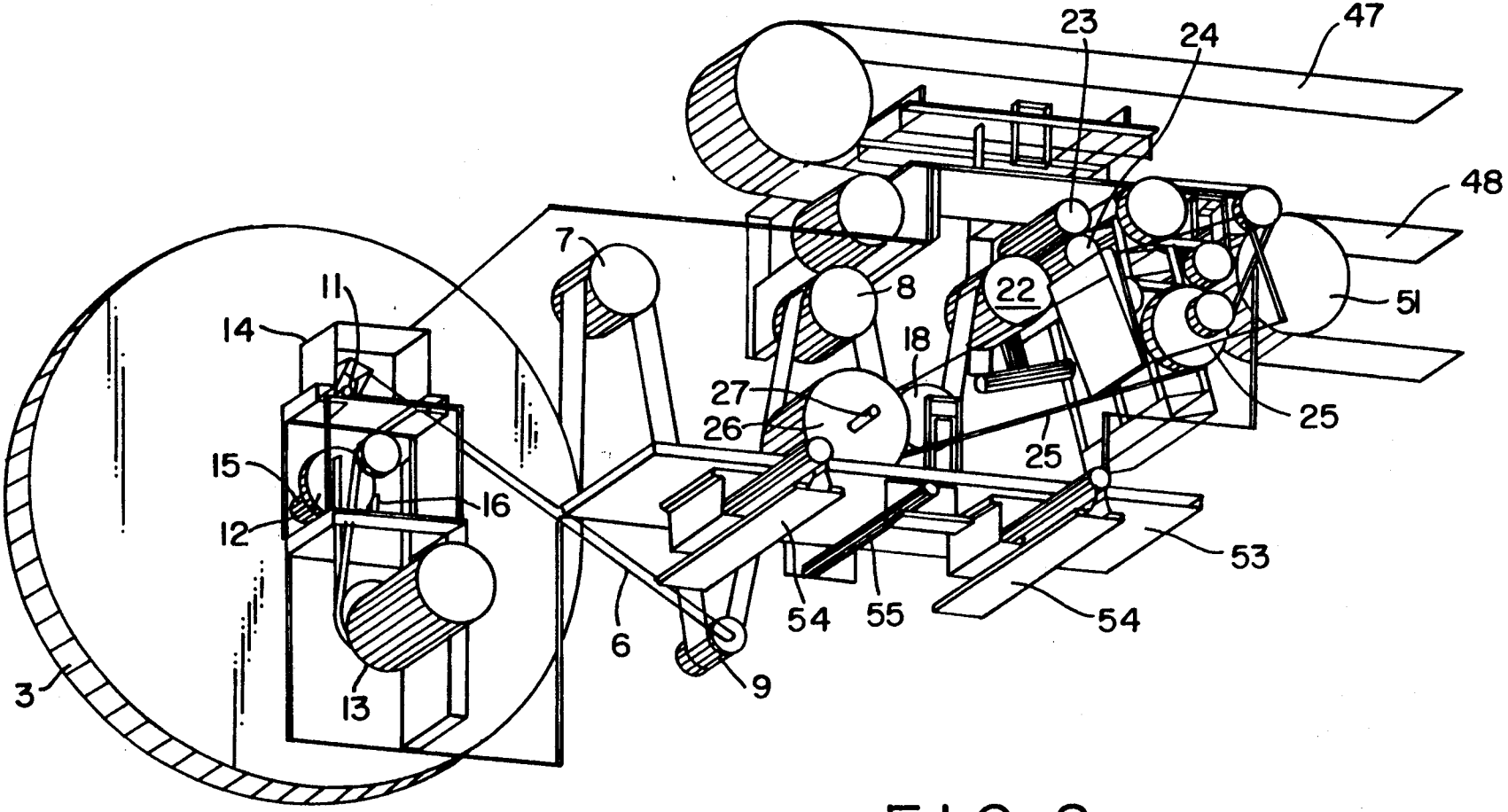
FIG. 2 is a perspective view of the apparatus as viewed from the lower rear, behind the position of the supply roll of web material.

Referring to FIGS. 1 and 2 the apparatus of the invention is illustrated as working in line with a continuous panel assembly system. In this preferred embodiment web and feed mechanisms are situated beneath panel transport belts 1 of the panel assembly system or host unit. Panels 2 move through the system along belts 1 above. As illustrated, the apparatus is disposed with its web feed axis aligned with the edge of the moving panels.

Web material is fed from a continuous supply roll of material 3. The roll is sufficient in size to supply web material for numerous panels. The web is fastened in place by a hub clamping apparatus 4 which uses a screw mechanism to clamp the cardboard center core of the web roll tightly to the axle which supports the web.

A means for unwinding the web material from the continuous roll and maintaining constant tension in the material to assure proper tracking of the material is provided. In a preferred embodiment, this is a motorized unwind system which turns the roll at varying speeds depending on the position of a movable dancer arm 6. The dancer by virtue of its weight against the material provides a constant tension in the web material. The web material is unwound from the supply roll and is disposed to follow a path upward over an idler pulley 7. The web loops over the idler 7 and passes downward under the moving idler 9 on dancer arm 6, and then back up again over a third idler 8.

The dancer arm 6 consists of a rod which is weighted at one end by a dancer idler or roller 9. The roller 9 is positioned so that its axis lies perpendicular to the direction of web travel. The web 10 is disposed to loop around this dancer roller 9 in between the two idler rolls 7, 8 along its path of travel. The dancer rod 6 is fixed to pivot about an axis which allows the rod to pivot in such a manner that the roller 9 on the end of the dancer moves vertically beneath the two idler rolls 7, 8.

The moving idler or dancer 6 is constrained to move in a path around a center pivot point 11 (see FIG. 2) and its movement approximates a vertical movement with the axis of the moving pivot constrained to remain always perpendicular to the plane of web travel. The web loops around this moving idler 9 in a manner which supports the weight of the moving idler and its support rod 6. The weight of the rod 6 and idler 9 resting on the loop of web 10, in turn, tensions the web to assure that it tracks properly while being fed through the machine.

Unwinding web material from the roll 3 is accomplished as the roll is turned by a variable speed electric motor 13. The motor 13 is controlled by a conventional motor controller (not illustrated) which senses the value of electrical resistance of a potentiometer 14 and responds to changes in resistance by varying the motor speed. The controller is wired to a potentiometer or variable resistor 14 connected to the pivot point 11 of the movable rod 6 which supports the moving idler 9.

As the idler 9 moves up and down the pivot 11 and the potentiometer 14 to which it is connected are rotated. The resistance of the potentiometer 14 rises or falls and the motor speed increases of decreases in response always in a manner which will work toward keeping the same amount of web material in this part of the system. The smaller the diameter of the supply roll 3, the more rotational speed is required to release the same amount of web material, the higher the rod 6 moves and the faster the motor 13 runs in response.

Thus, it can be seen that the dancer pivot 11 is connected to a variable resistor 14, the resistance value of which changes as the dancer moves up and down turning the pivot. The resistance of the variable resistor is wired electrically into a circuit of a direct current electric motor controller (not illustrated) in such a manner as to vary the speed of the electric motor 13 as the dancer pivots. The electric motor 13 is in turn connected directly to a shaft 15 supporting the roll of web material. This arrangement causes the web to unwind material as the shaft 15 turns. The shaft speed, in this arrangement, increases as material is used by the system and the dancer moves up. The shaft speed decreases as material is fed off of the roll 3 lowering the dancer 6. A mechanical brake 12 is applied when the dancer lowers to a preset point stopping the motion of the unwind shaft completely until the web material is again used sufficiently to raise the dancer. The weight of the dancer roller 9 rests at all times on the web assuring a constant tension is maintained within the web at all times.

A commercial reflective sensor 16 is positioned to monitor the inner diameter of the web supply roll 3. Sensor light is reflected by the roll and a detector signals the motor controller that web material remains on the web. When the web is depleted to a point near the inside diameter of the roll sensor light is no longer reflected and the sensor 16 sends a signal to the controller indicating that the web supply roll is depleted. The controller then continues the feed cycle for the present panel but after the present web has been severed the controller stops the cycling of the apparatus and sends a signal to the controller of the host unit (panel assembly system) to stop its operation so that the web supply roll can be replaced.

The brake is applied to stop rotation of the web when the low web sensor detects that it is time to change web supply rolls and a feed cycle is ended.

The web path continues from the moving idler roll 9, up and over idler 8 then down around a fourth idler 18. The orientation of the fourth idler 18 is adjustable in the horizontal plane by means of adjustable side guides which include a horizontally disposed pivot 19, a lever arm 20 and a screw in and spring return adjustment 21. Rotation of the adjustment 21 causes the end of the lever 20 opposite the pivot 19 to move toward or away from the plane of web travel. This in turn causes the lever arm 20 to rotate about the pivot 19. The rotation causes the orientation of the idler 18 to likewise change. This adjustment in roller alignment allows for adjustment of the web position, steering the web 10 to adjust its position as it enters the tractor rolls and cutter portion of the apparatus.

The web path then continues over another idler 22, and into the tractor rolls 23 and 24. The tractor rolls grip the web 10 between them and push the end of the web material forward over a guide and into the cutter section of the apparatus.

Thus, it can be seen that the web is routed in a zigzag course through the idlers. The zigzag course is used to make the web material conform to the idler rolls for reasons of tracking and to assure that thin web material does not bunch together laterally due to tension along the longitudinal direction of the web.

Figure 3:
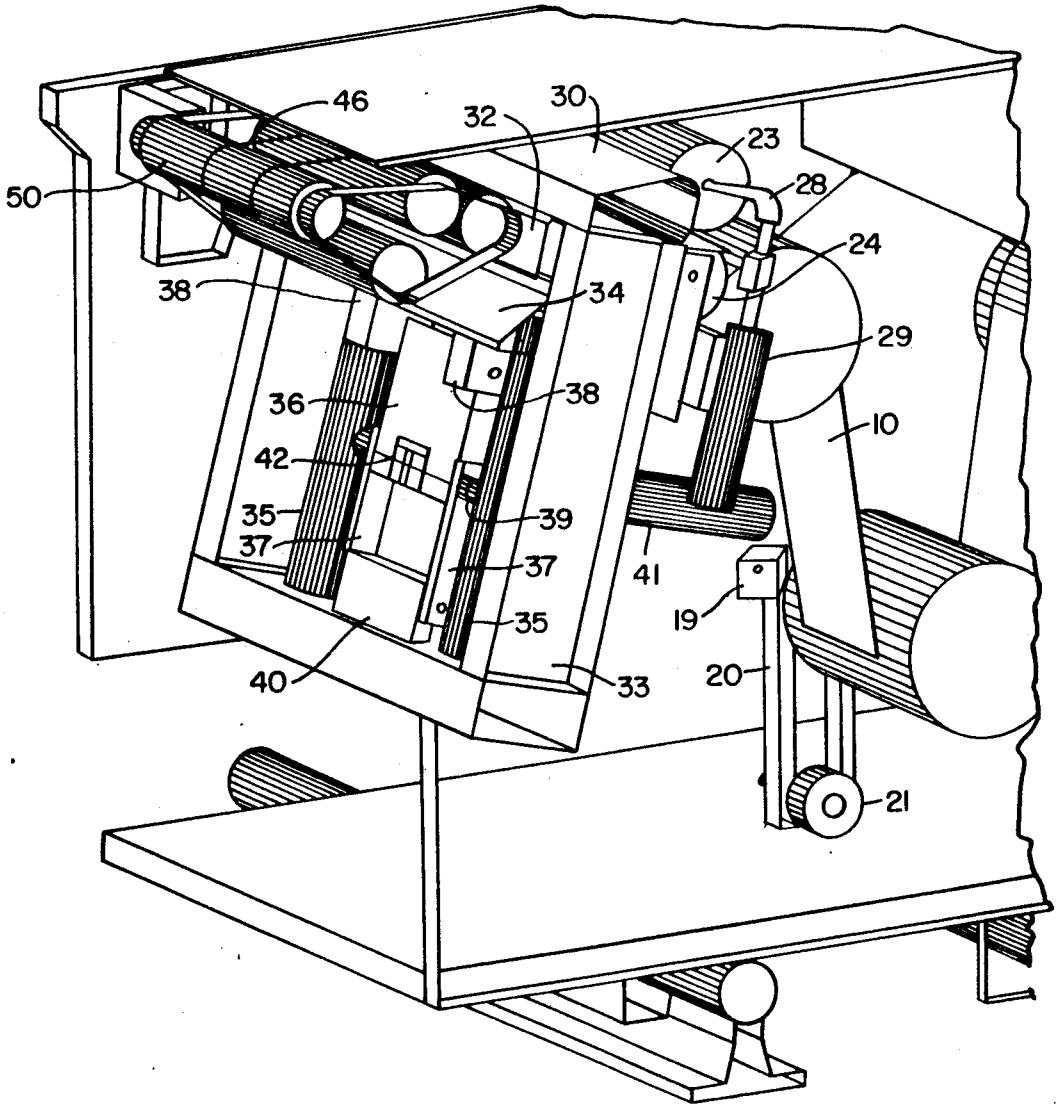
FIG. 3 is a perspective detailed view of the tractor roll and cutter portion of the apparatus.

The cutter assembly of the apparatus is illustrated in detail in FIG. 3. Material 10 enters between upper tractor roll 23 and lower tractor roll 24. The lower tractor roll 24 is fixed in position and is powered through the drive train 25 (see FIG. 2) at the rear of the apparatus. When the clutch 26 (see FIG. 2) on the drive train is engaged, the drive train 25 rotates and turns lower tractor roll 24 so that the surface speed of the roller matches the line speed of the process line. The clutch 26 is connected by its input shaft 27 directly to the drive train of the panel conveyor of the host system.

The upper tractor roll 23 is an idler. It is mounted on a pivot 28 which is actuated by two cylinders 29, one on each side of the web. The pivot constrains the upper roll 23 to move in opposition to the lower roll 24. The cylinders 29 when retracted causes the tractor rolls to move toward each other and engage the web material. Thus held, the web material is constrained to move with the tangent point or nip of the surface of the two rolls. When the rolls are paused the web is held stationary. When the clutch 26 engages, the web material is moved forward at the same speed as the panel in the host unit with which it is merging.

When the cylinders 29 extend the rolls move apart allowing the material to slide between them. This allows loading of the system and allows the web feed to be controlled by the panel conveyor after initial feeding is initiated by the tractor rolls. By opening the rolls and allowing the web to be pulled through by the panel conveyor the system eliminates problems which might be caused by small differences in the feed rate between the tractor rolls and the panel conveyor system.

As the web passes from the tractor rolls it is constrained on either side. On the top the web is guided by the anvil block 30 of the cutter section of the machine. On the bottom the web is guided and supported by a thin metal guide. The guide supports the web between the lower traction roll 24 and the tip of the cutter blade. Preferably, four fork-like extensions (not depicted) to the guide extend back from the guide and extend into four grooves (not depicted) on the lower traction roller. This prevents the web from adhering to the surface of the lower roller and thereby slipping under the guide causing a jam.

Cutting of the web is accomplished in a chopping manner with a sharpened blade 32 moving with some force against the anvil surface 30. The resulting action pinches the web material which is disposed between the blade and the anvil severing it.

The anvil 30 forms the top of a rigid rectangular frame 33. The blade on its guide block 34 are constrained to move in opposition to the anvil by a pair of linear guides 35 which can be ball bushings. The blade is propelled toward and away from the anvil by means of an "over center" lever mechanism consisting of an upper link 36 and a pair of lower links 37. The lower pivot of the lower set of links pivots around an axis in a lower pivot block 40 mounted stationary to the lower part of the rigid frame 33.

The upper link 36 pivots at its upper end around a pair of pivot blocks 38 mounted rigidly to the moving blade carrier 34. The top of the lower pivot and the bottom of the upper pivot are likewise pinned together by pin 39 to form the driving linkage. As the common pivot point 39 is driven by cylinder 41 to the position at which the linkages are in line the blade is pressed into the anvil with a large amount of force. This "over center" action causes the impinging blade to sever the web.

As the common pinned point 39 of the linkage is withdrawn from its "over center" position the blade 32 and anvil 30 move apart until the blade is withdrawn to below the top of the guide allowing free passage of the web material between the blade 32 and the anvil 30.

Thus, it can be seen that the lower link 37 pivots around a fixed location on the frame 33 to which the stationary anvil is rigidly mounted and is attached to the upper strut 36 at a center pivot point 39. The two struts are positioned with a slight angle between them and together comprise an over center toggle mechanism.

The moving means for the toggle is a pneumatic cylinder 41 joined to the center pivot point 39 of the struts to drive the struts laterally causing the struts 36, 37 to pivot from their angled position to a position in which the two struts are aligned and thereby move the end point of the struts fixed to the blade perpendicular to the cylinder motion. At the point where the struts are located in a straight line the blade 32 is driven into the anvil 30 with sufficient force to sever the material. When retracted the cylinder 41 returns the struts to their initial positions in which they are positioned with an angle between them thereby retracting the blade slightly to allow sufficient clearance for the web to be driven between the cutter blade edge and the anvil surface by the pinch rolls or pulled between them by the host system after the web is engaged.

Laterally disposed cylinder 41 is connected to the center pivot point of the linkage 42 for the purpose of supplying the lateral motion of the linkage to cause the cutting action previously described. Extending the cylinder 41 causes the pivot to move to its "over center" position causing cutting of the web. Retraction of the cylinder withdraws the pivot point and causes the links 36, 37 to retreat from their aligned "over center position". This action in turn withdraws the blade 32 and its carrier 34 along the guides rods 35 until sufficient clearance is present between blade and anvil to allow the web to easily slide through the opening.

Because the timing of the cut is critical to the position of the web, a special pneumatic circuit is utilized with separate commercial "3 way" solenoid valves used for extension and retraction of the cylinder 41. This allows air within the cylinder to exhaust to the atmosphere while the cylinder is in its retracted position. When the solenoid valve for extension of cylinder 41 is actuated, high pressure air is fed into the extension side of the cylinder. Because the retraction side of the cylinder has no high pressure air to counter the motion of the cylinder piston, as would be the case in a 4 way (directional control valve) arrangement, the cylinder reacts faster and with greater consistency than in a 4 way arrangement.

The timing of the clutch/brake 26, brake 12 and cylinder 41 extension actions are also affected by the reaction speed of their respective solenoids which are an integral component of each unit. For this reason, commercial spike generating controllers (not illustrated) are preferably used to enhance the reaction speed of these solenoids. The spike generator controls send a short burst of high voltage, usually three times the rated solenoid voltage, through the electromagnetic coil of the solenoid to cause fast actuation of the solenoid After the initial burst of voltage has actuated the solenoid, the voltage drops to the rated voltage for the solenoid to maintain the solenoid position.

From the cutter the end of the web is pushed forward and supported by a series of belts 46 which move at the same speed as the web and carry the web forward at an angle that causes the web to merge with the passing panel. The web and panel then pass together between upper 47 and lower 48 output belts which hold the two pieces (web and panel) together and convey them through the means of binding the two components together In this preferred embodiment the means of binding the components is a sewing machine 49.

The belts 46 function as a means of preventing the web material from gathering under a tensile load as it emerges from the tractor rolls 23, 24. The support belts are attached to the system drive which supports the web and carries it to a point of tangency with the top of the conveyor section carrying the panel sections. The support belts then bend away around a roller 50 allowing the web to merge with the panel through an opening in the conveyor belt. Allowance is made for two panel support conveyor rolls 51, 52 (see FIGS. 2 and 1) on either side of the feed position of the web to allow for continuation of the conveyor belt support on either side of the web feed position.

The web feed mechanism of the invention is disposed directly under the moving panel in the host unit panel conveyor to a point where the web joins with the panel at a shallow angle, therefore it is not possible to provide continuous panel conveyor support over a portion of the top of the web feeder system. A means of continuing positive engagement and controlled traction of the panel in the area directly above the web feed system, in a preferred embodiment, can be provided by a smooth, low friction plate 57 over the web feed system and a high friction tractor belt 47 which is continuously spring loaded downward against the top of the slide plate. This configuration causes the material to be induced to adhere to the surface of the high friction belt and slide along the top plate in a positively controlled manner.

The entire web feed apparatus is mounted upon a rigid frame 53 (see FIG. 2) which is in turn mounted at its bottom to slides 54 which are bolted within the frame of the host panel assembly system. The apparatus is positioned and maintained in the proper lateral position with the edge of the passing panel by means of a screw adjustment 55 in the preferred apparatus. The slides 54 afford a means of adding a commercial live edge guide should it become necessary to follow the edge of the panel more closely.

Two sensors 56 are disposed to view the top of the apparatus. The sensors emit a small beam of light which reflects off of the polished top plate 57 of the apparatus and detects the presence of the panel 2 when it blocks the reflection. This interruption in the reflected beam causes the sensors to close an internal switch sending a signal to the apparatus controller unit (not illustrated). The sensors are mounted on rails 58 to facilitate movement of the sensors toward and away from the direction of the oncoming panel. This adjustment allows adjustment in the trigger positions of the web feed and stop and therefore allows a positional adjustment in the relative placement of the ends of the web with respect to the panel.

The apparatus includes a commercial programmable controller unit (not illustrated). The controller unit can be a model SLC 150 programmable controller from Allen-Bradley. Solenoid operated directional control valves are coupled to a source of pneumatic pressure and to the pneumatic cylinders. Sensors sense positions of the leading and trailing edge of the incoming panel, the positions of the pneumatic actuators and the status of the web material on the feed roll and the position of the rod 6. The controller unit is responsive to the position sensors 16, 56 and is coupled to the clutch/brake 26, the brake 12, the solenoid operated directional control valves and the energizing means, and regulates the system solenoids and solenoid operated directional control valves and the energizing means to effect the operations of the present invention. Appropriate electrical signals are provided to coordinate operation of the web feeding system with the host panel processing system.

What is claimed is:

1. An apparatus for cutting and feeding web material from a roll stock and for merging a cut web material feed strip with a passing panel of material within a textile panel assembly host unit, said host unit having a drive system for moving said panel, said feeding being conducted in such a way as to dispose leading and trailing ends of the web feed strip even with leading and trailing edges respectively of the passing panel being processed, said apparatus comprising:

a roll of web material;

means for rotating said roll to allow for unwinding of web material therefrom;

means for cutting a strip of web material from said roll;

means for guiding web material from said roll to said means for cutting;

means for sensing a leading edge and a trailing edge of a passing panel moving within said host unit;

means for feeding a cut strip of web material and for merging the cut strip with said passing panel within said host unit, said means for feeding comprising a pair of opposing rollers having a nip therebetween for gripping web material from the means for guiding, and means for changing the relative position of the opposing rollers with respect to each other from a first position where the rollers can grip web material in said nip to a second position where the rollers cannot grip web material; and means for controlling actuation of said means for cutting and said means for feeding which is responsive to said means for sensing so that the means for cutting cuts web material into a strip having a leading end and a trailing end and the means for feeding feeds the strip and merges the strip with said passing panel such that the leading end and trailing end of said strip coincide with the leading edge and trailing edge, respectively, of said passing panel.

2. The apparatus according to claim 1 wherein the means for feeding is coupled to the drive system of the host unit by a clutch.

3. The apparatus according to claim 1 wherein the means for cutting includes a blade slidably mounted within a stationary frame which defines an anvil surface against which the blade is movable.

4. The apparatus according to claim 3 wherein the means for cutting further includes a toggle disposed between the blade and a section of the frame and a means for actuating the toggle to propel the blade into the anvil.

5. The apparatus according to claim 4 wherein the means for actuating the toggle is a piston.

6. The apparatus according to claim 5 wherein the means for cutting further includes two 3-way solenoid powered air valves for controlling extension and retraction of the piston in response to the means for controlling.

7. The apparatus according to claim 1 wherein the means for changing relative position is a piston and a solenoid powered air valve belonging to a first one of the pair of rollers, actuation of said piston being controlled by the solenoid powered air valve which is responsive to the means for controlling.

8. The apparatus according to claim 7 wherein the second one of the pair of rollers is powered for rotational movement to advance web material through the apparatus.

9. The apparatus according to claim 8 wherein the second one of the pair of rollers is powered by the drive system of the panel assembly host unit so as to move web material at the same speed as the passing panel within the host unit.

10. The apparatus according to claim 9 wherein the second one of the pair of rollers is coupled to the drive system by a clutch.

11. The apparatus according to claim 1 wherein the means for guiding web material includes a plurality of rollers which are disposed to form a zigzag path for the web material and which tension the web material.

12. The apparatus according to claim 11 wherein the means for guiding web material includes a first roller which receives web over its topside, a second roller which receives web around its underside, a third roller which receives web over its topside, a fourth roller which receives web around its underside and a fifth roller which receives web around its topside.

13. The apparatus according to claim 12 wherein the second roller of the means for guiding has an axis around which it rotates, said axis being connected to a rigid movable arm which is movable about a pivot point of connection to a frame of the apparatus, said second roller being supported by web material around its underside.

14. The apparatus according to claim 13 wherein the means for rotating said roll to allow for unwinding of web material is a motor which is responsive to the position of the movable arm supporting the second roller.

* * * * *